US005330373A

United States Patent [19]

Terayama

[11] Patent Number: 5,330,373

[45] Date of Patent: Jul. 19, 1994

[54] SOCKET FOR A LAMP

[75] Inventor: Takashi Terayama, Yokohama, Japan

[73] Assignee: Stanley Electric Co., Ltd., Tokyo, Japan

[21] Appl. No.: 992,609

[22] Filed: Dec. 18, 1992

[51] Int. Cl.[5] ..... H01R 13/24

[52] U.S. Cl. ..... 439/700; 439/672; 439/740

[58] Field of Search ..... 439/672, 700, 740, 734, 439/824, 733, 332, 335, 336, 613; 292/212

[56] References Cited

U.S. PATENT DOCUMENTS

| | | | |
|---|---|---|---|
| 2,389,454 | 11/1945 | Picard | 439/740 |
| 3,031,639 | 4/1962 | Majewski | 439/740 |
| 3,122,407 | 2/1964 | Cowe | 439/740 |
| 4,760,721 | 8/1988 | Steinbach | 292/212 |

*Primary Examiner*—Larry I. Schwartz
*Assistant Examiner*—Hien D. Vu
*Attorney, Agent, or Firm*—Louis Weinstein

[57] ABSTRACT

A lamp socket for a vehicle includes a central electrode having a substantially rectangular button-shaped terminal disposed at the central part of a circular disc-shaped insulator and a coil spring for normally biasing the insulator. The button-shaped terminal is fixedly connected to a cord via a caulking portion and has the same sectional contour as that of a through hole formed through the insulator at the central part of the latter so as to allow the button-shaped terminal to be inserted therethrough, and a fitting groove is formed on said insulator at the position located angularly offset from the through hole by an angle of about 90° so as to enable the button-shaped terminal to be fitted into the fitting groove. A clip portion is disposed on the rear surface side of the insulator so as to firmly hold the button-shaped terminal by engaging the caulking portion with the clip portion when the button-shaped terminal is inserted through the through hole and then turned by an angle of 90°.

8 Claims, 2 Drawing Sheets

SOCKET FOR A LAMP

FIELD OF THE INVENTION

The present invention relates generally to a socket for a lamp. More particularly, the present invention relates to a lamp socket for a lamp used in an illuminating instrument or the like provided in a vehicle.

BACKGROUND OF THE INVENTION

A typical conventional lamp socket of the foregoing type is shown in FIG. 4. The lamp socket 90 is substantially constructed of a cylindrical outer sleeve 91 made of a metallic sheet material, a central electrode assembly 92 including member 93 molded of an insulation material, such as a resin, into a circular disc-shaped contour, a button-shaped conductive terminal 94 having an electric wire connected thereto (see FIG. 5), and a coil spring 95 adapted to expand and contract within the outer sleeve 91 by a predetermined distance while supporting the central electrode assembly 92. A connector terminal 96 is typically fixedly secured to the other end (right-hand end as seen in the drawing) of the electric wire 94*b* for making connection to a wiring system in the vehicle (not shown).

With the conventional lamp socket 90 constructed in the above-described manner, assembly of the central electrode assembly 92 is achieved by caulking the left-hand end of electric wire 94*b* to a terminal portion 94*a* to prepare the button-shaped terminal 94. Thereafter, the button-shaped terminal 94 is manually inserted through a fitting hole 93*a* by inserting the right-hand end of electric wire 94*b* into the front side of member 93, and subsequently, connecting the right-hand end of electric wire 94*b* to the connector terminal 96 as shown in FIG. 5. In other words, each assembling operation is continuously performed by conducting a plurality of steps in following the order: caulking step (94*a* to 94*b*) →inserting step (94*b* through 93*a*) →caulking step (94*b* to 96), resulting in a complicated assembly operation. Consequently, there arises a problem that productivity of a production line for producing lamp sockets is degraded.

SUMMARY OF THE INVENTION

The present invention is designed to reduce the complicated assembly steps set forth above.

An object of the present invention is to provide a lamp socket which assures that each assembly operation can be performed in a simplified manner.

According to the present invention, there is provided a lamp including a central electrode assembly having a substantially rectangular button-shaped terminal disposed at the central part of a circular disc-shaped insulator and a coil spring for normally biasing the central electrode, the button-shaped terminal having an electric wire connected thereto, wherein a through-hole is formed at the central part of the insulator to allow the button-shaped terminal to be inserted therethrough from the rear side thereof, the through-hole having the same shape as that of the button-shaped terminal, a fitting groove being formed in the front surface of the insulator and being angularly offset from an axis of the through-hole by an angle of about 90° so as to enable the button-shaped terminal to be seated in the fitting groove, and a clip portion disposed on the rear surface side of the insulator to firmly hold the button-shaped terminal when the terminal is seated in the fitting groove.

The button-shaped terminal is seated in the fitting groove after it is inserted through the through-hole and then turned by an angle of about 90°.

To make connection to the electric wire, the button-shaped terminal includes a caulking portion on the rear surface side of the insulator, and the caulking portion is engaged with the clip portion when the button-shaped terminal is turned by an angle of about 90°.

Other objects, features and advantages of the present invention will become readily apparent when reading the following description and accompanying drawings.

BRIEF DESCRIPTION OF THE FIGURES

The present invention is illustrated i the following drawings in which.

DETAILED DESCRIPTION OF THE INVENTION AND PREFERRED EMBODIMENTS THEREOF

The present invention will now be described in detail hereinafter with reference to the accompanying drawings which illustrate a preferred embodiment thereof.

Figure 1:
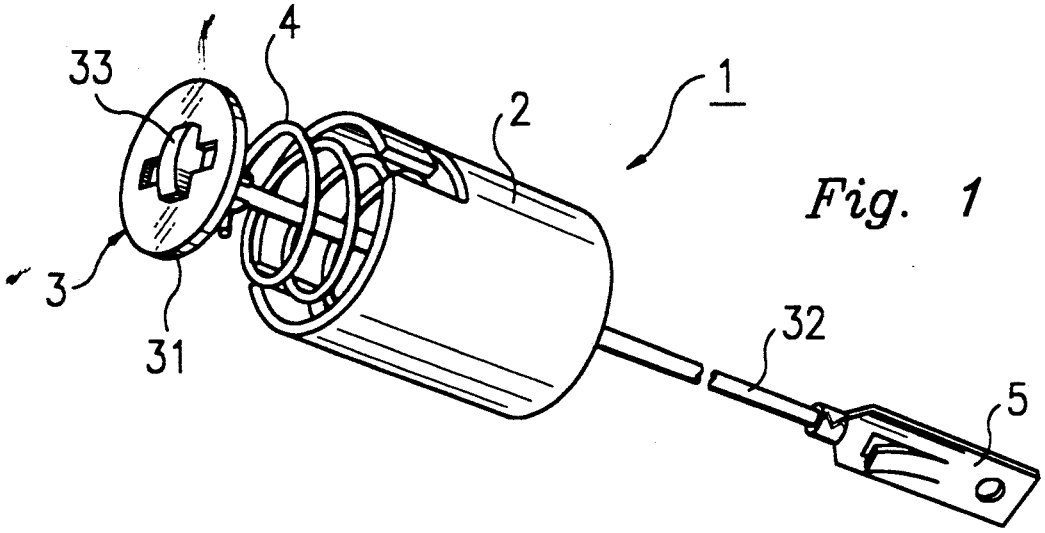
FIG. 1 is a perspective view of a lamp socket in accordance with an embodiment of the present invention, particularly showing the lamp socket in the disassembled state.
Figure 4:
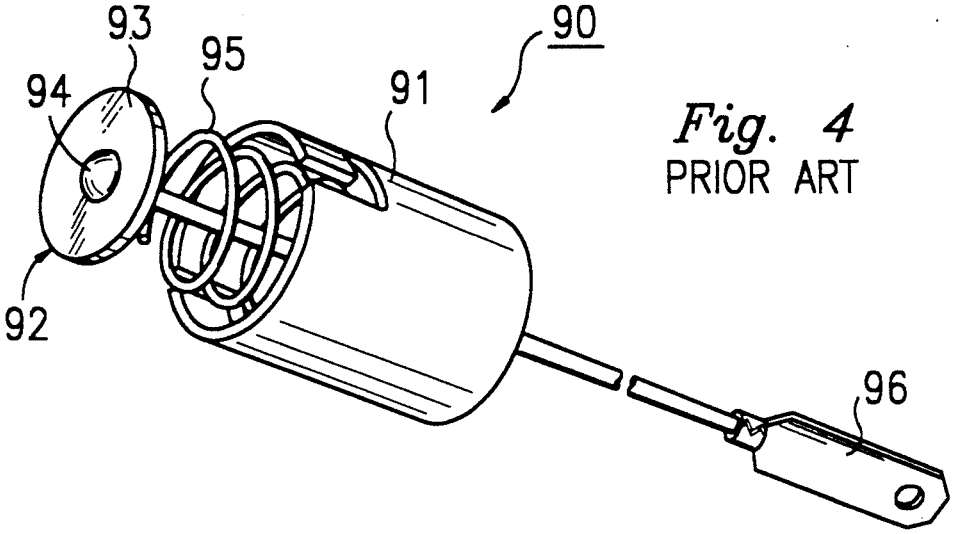
Fig. 4 PRIOR ART
FIG. 4 is a perspective view of a conventional lamp socket, particularly showing the lamp socket in the disassembled state.
Figure 5:
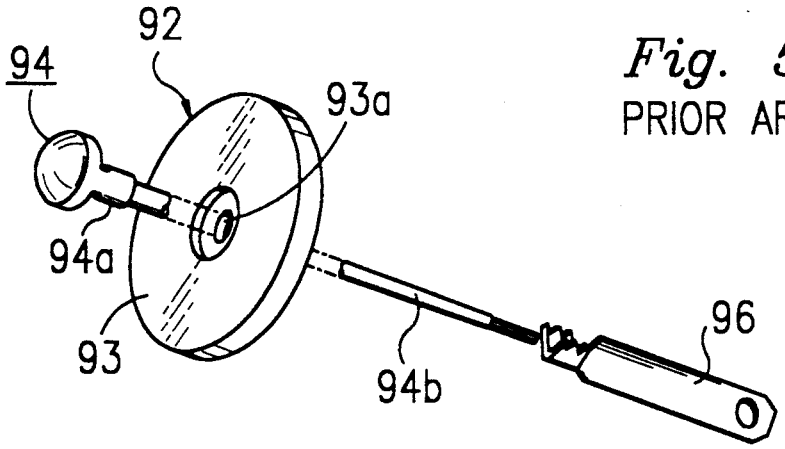
Fig. 5 PRIOR ART
FIG. 5 is a perspective of the conventional lamp socket, particularly showing essential components constituting the lamp socket.

In FIG. 1, reference numeral designates a lamp socket in accordance with the embodiment of the present invention. The lamp socket 1 comprises an outer sleeve 2, a central electrode assembly 3 and a coil spring 4 similar to the conventional lamp socket described above with reference to FIG. 4 and FIG. 5. In this embodiment, an assembling operation can be performed in a substantially simplified manner such that a button-shaped terminal 33 having an electric wire 32 connected thereto and forming a part of the central electrode assembly 3 is inserted into the button-shaped terminal 33 through a hole 31*a* formed at the central part of an insulator 31. Terminal 33 is then moved a short distance beyond the front surface of the insulator. Thus, in contrast with the conventional lamp socket as described above with reference to FIG. 4 and FIG. 5, the necessity for inserting the entire length of the electric wire 32 through through-hole 31*a* of the insulator 31 is avoided.

Figure 2:
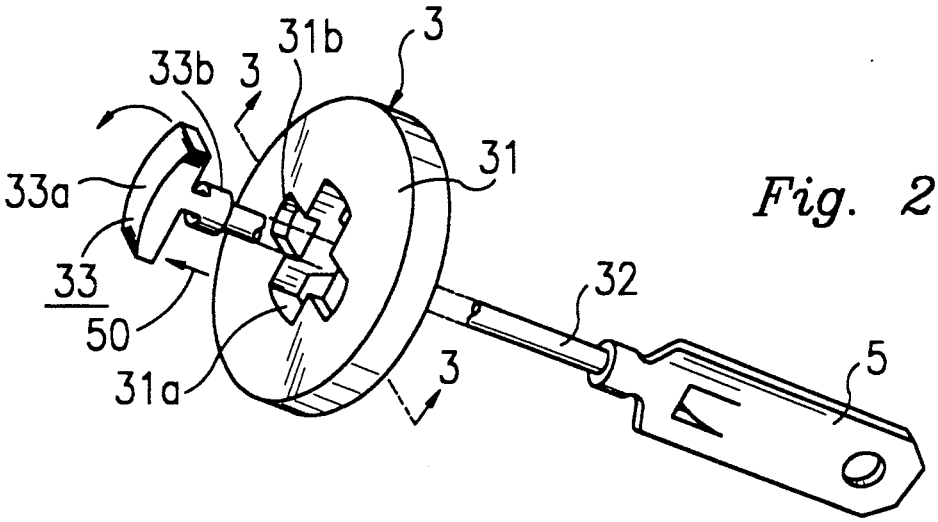
FIG. 2 is a perspective view of the lamp socket, particularly showing essential components constituting the lamp socket.
Figure 3:
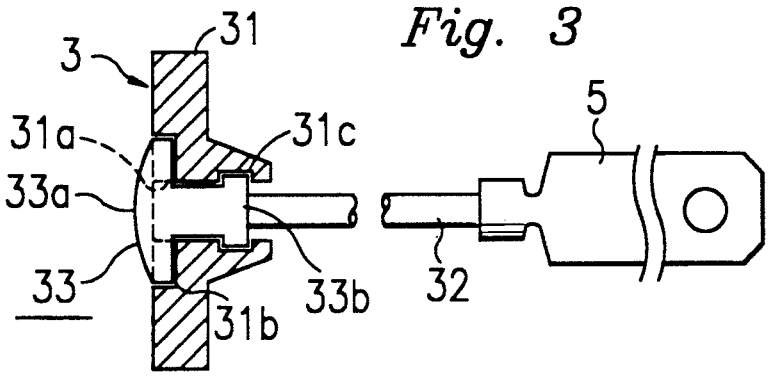
FIG. 3 is a sectional view of the lamp socket taken along line 3—3 in FIG. 2.

FIG. 2 and FIG. 3 show an enlarged view of the central electrode assembly 3 for the convenience of easy understanding. Specifically, a terminal portion 33*a* of the button-shaped terminal 33 has a substantially rectangular contour as seen from the front side, and the button-shaped terminal 33 includes a caulking portion 33*b* for connecting electric wire 32 thereto.

The shape of through hole 31*a* is the same as that of the terminal portion 33*a* of the button-shaped terminal 33 (i.e. rectangular) to enable the button-shaped terminal 33 to be inserted therethrough. In addition, a fitting groove 31*b* adapted to receive the terminal portion 33*a* of the button-shaped terminal 33 is formed on the front surface side of the insulator 31, i.e., the side facing a lamp (not shown). Fitting groove 31*b* is angularly offset from through-hole 31*a* by an angle of about 90°. The insulator 31 includes a clip portion 31*c* on the rear surface, and the clip portion 31*c* engages the caulking portion 33*b* of the button-shaped terminal 33 when the terminal portion 33*a* of the button-shaped terminal 33 is seated in fitting groove 31*b*.

The following is a description of the assembly procedure of the central electrode 3 constructed in the above-described manner.

First, the terminal portion 33*a* of the button terminal 33 is inserted in the direction of arrow 50 into the through hole 31*a* of the insulator 31 from the rear side to move the terminal portion 33*a* past (i.e. beyond) the front surface of the insulator 31. At this time, the electric wire 32 is connected to the button-shaped terminal 33 via the clip portion 31*c*. In such manner, the central electrode assembly 3 is properly assembled (see FIG. 3).

Next, a function of the lamp socket 1 is constructed in the aforementioned manner will be described below.

As described above, to perform a step of assembling the central electrode assembly 3, electric wire 32 is inserted through the hole 31*a* of the insulator 31, and thereafter, terminal 33 is rotated by an angle of about 90° and is seated in the fitting groove 31*b*. It should be added that a caulking step can be achieved at the same time as the foregoing assembling step. Thus, in contrast with the conventional lamp socket, the necessity that the step of caulking the electric wire 32 is performed later separately from the step of inserting the electric wire 32 through the through hole 31*a* is avoided.

For the purpose of easy understanding, the present invention has been described above with respect to the embodiment wherein the central electrode assembly 3 includes a single button-shaped terminal 33. It should of course be understood that the present invention should not be limited only to this embodiment but it may equally be applied to another embodiment wherein the central electrode 3 includes two button-shaped terminals of the type described above for use with a double filament type lamp.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. In a lamp socket including a central electrode having a substantially rectangular button-shaped terminal having a given shape disposed at a central part of a circular disc-shaped insulator and a coil spring for normally biasing said central electrode, said button-shaped terminal having an electric cord connected thereto, the improvement comprising:

a substantially rectangular-shaped through-hole formed at the central part of said insulator and being sized to allow said button-shaped terminal to be inserted therethrough, said through hole having a sectional shape conforming to the shape of said button-shaped terminal;

a fitting groove formed on a front surface of said insulator at a position angularly offset from said through hole by angle of about 90° and being sized to enable said button-shaped terminal to be seated in said fitting groove, and said insulator having an integral clip portion arranged on a rear surface of said insulator to permit the button-shaped terminal to pass through said clip portion when the button-shaped terminal is aligned to pass through said through-hole and to hold said button-shaped terminal when the button-shaped terminal is seated in said fitting groove.

2. The lamp socket according to claim 1, wherein said button-shaped terminal is seated in said fitting groove after it is inserted through said hole and then rotated through an angle of about 90°.

3. The lamp socket according to claim 1, wherein said button-shaped terminal includes a caulking portion for connecting said cord thereto, said caulking portion being engaged with said clip portion when said button-shaped terminal is turned by an angle of about 90°.

4. A lamp socket according to claim 1, wherein said electric cord connecting portion has an enlarged end portion; and said integral clip portion has a recess for snap-fittingly receiving the enlarged end portion of said electric cord connection portion.

5. An assembly for a lamp socket comprising:

a disk-shaped insulating member;

a button-shaped electric terminal having a generally rectangular-shaped head portion and an integral electric cord connecting portion for receiving one end of an electric cord;

said insulating member having a through-opening of a shape conforming to an outer peripheral shape of said head portion to enable said head portion to be inserted through said through-opening without interference to enable said terminal to extend beyond a front face of the insulating member; and said insulating member having a recess in the front face, the recess being of a shape conforming to the outer periphery of said head portion, said recess and said through-opening having longitudinal axes transverse to one another, whereby the head portion may be seated in said recess when aligned therewith to prevent rotation of the terminal relative to the insulating member.

6. An assembly according to claim 5, wherein said insulating member is provided with an integral clip portion along a rear surface for snap-fittingly receiving said cord connecting portion when said head portion is seated in said recess.

7. A method for producing an assembly for a lamp socket comprised:

an electric cord;

a disk-shaped insulating member, a button-shaped electric terminal having a generally rectangular-shaped head portion, and an integral electric cord connecting portion for receiving one end of said electric cord, said insulating member having a through-opening of a shape conforming to an outer peripheral shape of said head portion to enable said head portion to be inserted through said through-opening.

said insulating member having a recess in a front face, the recess being of a shape conforming to the outer periphery of said head portion, said recess and through-opening having longitudinal axes transverse to one another, said insulating member having a rear surface provided with an integral clip portion for snap-fittingly receiving said electric cord connecting portion, said method comprising the steps of:

(a) inserting one end of the electric cord into said electric cord connecting portion;

(b) caulking said one end of said electric cord to said electric cord connecting portion to form a cable connecting portion;

(c) assembling the cable connecting portion and insulating member to one another by inserting the head portion into said through-opening from said rear surface and moving the head portion so that said head portion extends beyond the front face of the insulating member;

(d) rotating said head portion through an angle sufficient to align said head portion with said recess; and (e) pressing said head portion into said recess, which thereby substantially simultaneously causes said electric cord connecting portion to be snap-fitted within said clip portion.

8. The method of claim 7 further comprising caulking a connecting electric terminal to an opposite free end of said electric cord.

* * * * *